US005443683A

United States Patent [19]

Garrett

[11] Patent Number: 5,443,683

[45] Date of Patent: Aug. 22, 1995

[54] GLUE UNIT

[76] Inventor: Jimmy R. Garrett, Rte. 1, Box 569, Worden, Ill. 62097

[21] Appl. No.: 125,786

[22] Filed: Sep. 24, 1993

[51] Int. Cl.[6] ..... B05C 1/00

[52] U.S. Cl. ..... 156/578; 118/258; 118/259; 118/261; 118/227

[58] Field of Search ..... 156/578; 118/211, 212, 118/258, 259, 261, 262, 226, 227

[56] References Cited

U.S. PATENT DOCUMENTS

| | | | |
|---|---|---|---|
| 2,273,021 | 2/1942 | Cox, Jr. | 91/49 |
| 2,624,914 | 1/1953 | Rhodes | 18/12 |
| 2,641,220 | 6/1953 | Weber et al. | 118/259 |
| 2,787,244 | 4/1957 | Hickin | 118/259 |
| 2,868,160 | 1/1959 | Paulsen | 118/259 |
| 2,911,942 | 11/1959 | Gross | 118/259 |
| 2,970,564 | 2/1961 | Warner | 118/261 |
| 3,245,379 | 4/1966 | Lopez | 118/250 |
| 3,450,093 | 6/1969 | Gugolz | 118/7 |
| 3,568,636 | 3/1971 | Lockwood | 118/259 |
| 4,167,916 | 9/1979 | Pierce | 118/212 |
| 4,343,260 | 8/1982 | Yajima et al. | 118/204 |
| 4,347,095 | 8/1982 | Yamashita | 156/578 |
| 4,351,264 | 9/1982 | Flaum et al. | 118/203 |
| 5,160,570 | 11/1992 | Dickey | 156/448 |

*Primary Examiner*—James J. Engel
*Attorney, Agent, or Firm*—Grace J. Fishel

[57] ABSTRACT

A glue unit having a glue shoe and a glue wheel. The glue shoe has an adjustable metering plate and the glue wheel has a rim with depressions in its central area flanked by smooth side sections. The glue shoe has front, rear and side walls that are closed at the top with a top wall with the space between the walls forming a glue reservoir. The side walls seal to the glue wheel along its smooth side sections confining the glue in the reservoir and keeping the smooth side sections clean. The rear wall is shorter than the side walls and has a recess into which the metering plate is mounted with means for adjusting the metering plate toward and away from the glue wheel for use in applying a film of glue to the depressions. The front wall is coterminous with the side walls and has a plurality of notches permitting return of the glue to the reservoir.

10 Claims, 2 Drawing Sheets

GLUE UNIT

BACKGROUND OF THE INVENTION

1. Field of the Invention

The present invention relates to a glue unit having a glue shoe with an adjustable metering plate and a glue wheel. The glue unit is for use in applying glue or the like to a glue flap of a paperboard box blank in a folder-gluer machine.

2. Brief Description of the Prior Art

In the manufacture of a cardboard or paperboard shipping container, glue is applied to a tab called a glue flap that projects from one of the outside panels of a box blank. After the glue is applied, the two outside panels are folded onto the two inside panels to convert the box bank into a collapsed flat folded form. This operation is performed in a folder-gluer machine. The flat folded blank may thereafter be shipped to a customer for erection and filling with product to be shipped therein.

The glue is usually applied to the glue flap so that, when the box is erected for filling the glue flap is on the inside of the box. The filling of some containers, however, requires that the glue flap be on the outside of the container, even though aesthetically, the glue flap is preferably on the inside. Since the box blank may be folded with the glue flap either above or below the adjacent panel, it is necessary for the gluer to be able to apply the glue either above and below the flap.

In the past, applicator wheels and shoes have been used to apply glue to the glue flap. With these devices, excessive wear takes place if the fit between the shoe and the wheel is too snug but if the shoe is too loose, glue may be slung off the wheel. There have also been problems in applying the glue uniformly from a position above and below the flap.

Extruders have been used in place of prior art applicator wheels and shoes because of the above-mentioned problems. To create a strong container, however, the glue must be applied to the glue flap uniformly and in an effective amount. When an extruder is used, it must be turned on and off quickly between successive glue flaps. As the box blanks travel through the gluer-folder, it is difficult, if not impossible, to obtain a uniform bead of glue consistently over the entire length of each glue flap. Another problem is that extruders drip glue from the nozzle and the nozzle tends to clog up with dried glue changing the amount of glue applied. When the flaps are not glued adequately, the container may rupture while it is being filled or during shipment of the product. Sometimes the extruders overspray the box blanks so that the flat folded blanks stick together. These problems tend to be reported by the customer and get back to the maker of the container.

Glue shoes and wheels are easier to control than extruders and would be preferred if the disadvantages of the prior art could be overcome.

SUMMARY OF THE INVENTION

In view of the above, it is an object of the present invention to provide a glue shoe with a metering plate for applying a uniform, controlled amount of glue to a glue wheel in a manner that overcomes the disadvantages of the prior art. Other objects include providing a glue unit having a glue shoe and glue wheel that can be used to glue either side of a glue flap, that can be used to apply a uniform layer of glue over the entire length of each glue flap and that does not sling glue off the glue wheel. Other objects and features of the invention will be in part apparent and in part pointed out hereinafter.

In accordance with the invention, a glue unit for applying glue to a glue flap has a rotatable glue wheel and a glue shoe. The glue wheel has a rim with depressions for carrying glue to the flap. The depressions are flanked by smooth side sections. The glue shoe has side walls and front and rear walls. The side walls are positioned transversely to the axis of the wheel and have bottom surfaces. The bottom surfaces of the side walls are curved complementary to the smooth side sections of the rim for sealing engagement with them. The front and rear walls are positioned parallel to the axis of the wheel. The rear wall has an adjustable metering plate extending across the rim to the smooth side sections. Means are provided for mounting the metering plate for adjustment towards and away from the wheel. In operation, the bottom surfaces of the side walls clean the smooth side sections of the rim while the metering plate applies a film of glue to the depressions.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 2:
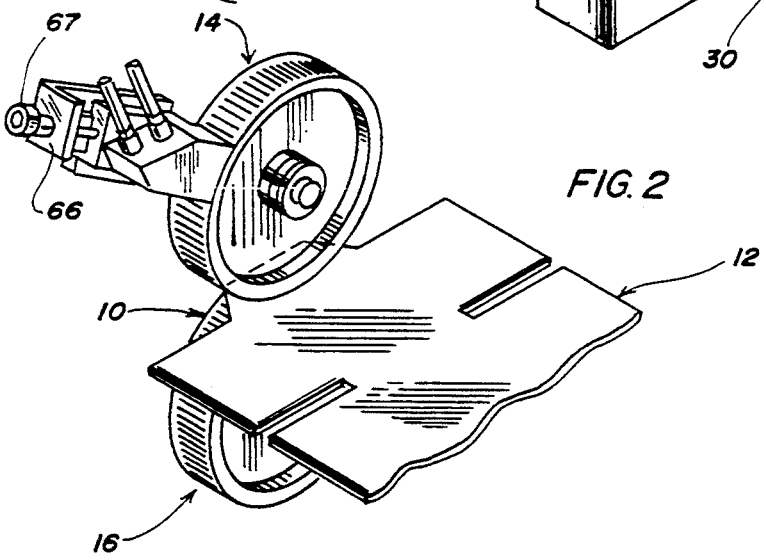
FIG. 2 is a detail from FIG. 1 showing the glue units applying glue to a glue flap.

In the manufacture of cardboard or double-faced corrugated paperboard shipping containers as shown in FIG. 2, glue is applied to a tab 10 called a glue flap which projects from one of the outside panels of a box blank 12. With continuing reference to FIG. 2, glue flap 10 is shown passing between an upper glue unit 14 and a lower glue unit 16 in accordance with the present invention.

Figure 1:
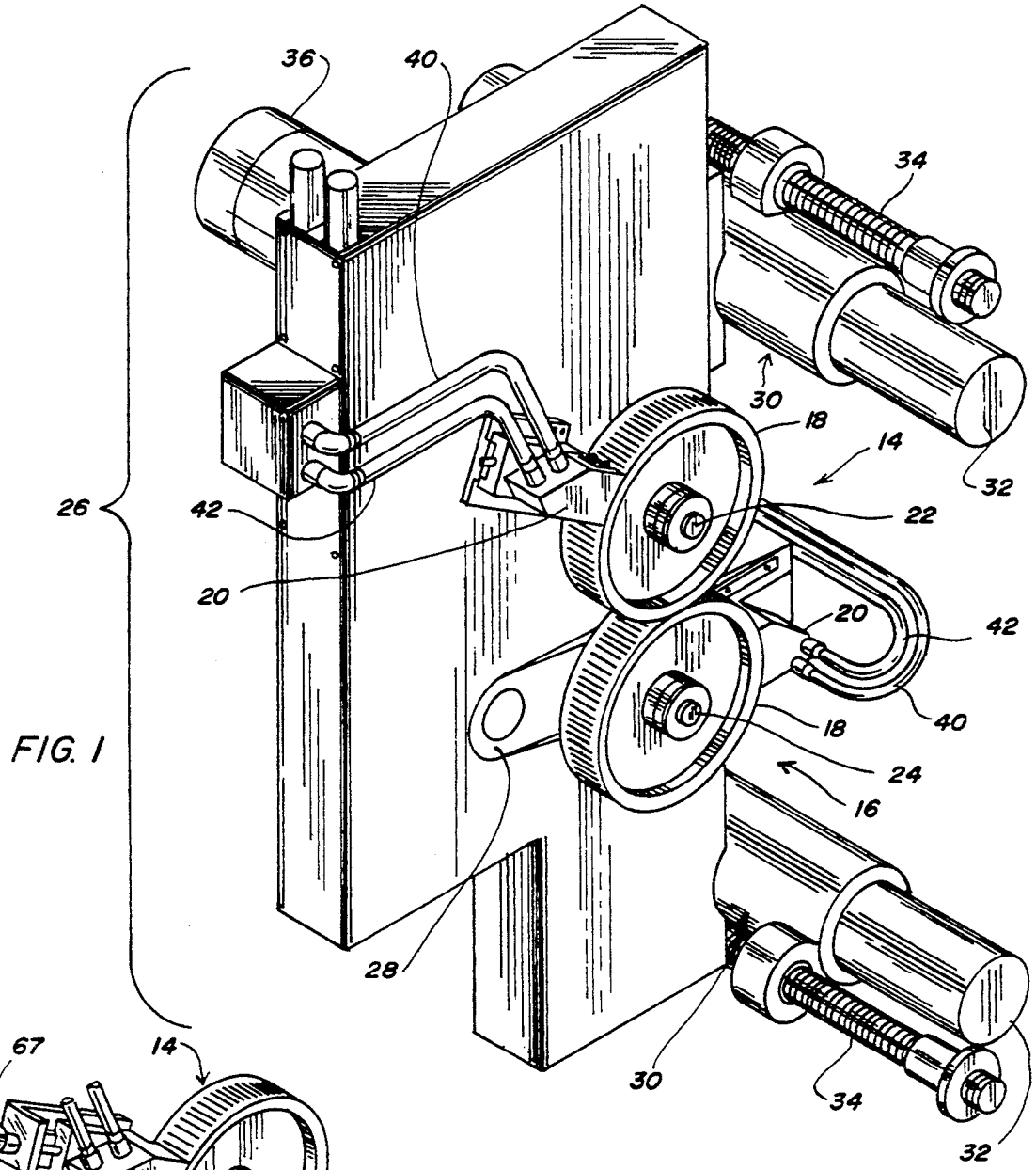
FIG. 1 is a perspective view of two glue units in accordance with the present invention mounted as part of a self-contained assembly.

Turning now to FIG. 1, each of glue units 14, 16 includes, in essential part, a glue wheel 18 and a glue shoe 20 more particularly described hereinafter. Glue units 14, 16 selectively apply glue either to the top surface of glue flap 10 or to the bottom surface. When upper glue unit 14 is applying glue, glue wheel 18 of lower glue unit. 16 serves as a pressure roller providing support for the bottom surface of glue flap 10. Conversely, when lower glue unit 16 is applying glue to the bottom surface of glue flap 10, upper glue unit 14 serves as a pressure roller.

As illustrated in FIG. 1, glue units 14, 16 are mounted on top and bottom shafts 22, 24, respectively, and are part of a self-contained assembly 26. Bottom shaft 24 is mounted in assembly 26 on a pivotable lever 28 for adjusting the nip between glue wheels 18. This adjustment is provided to accommodate glue flaps 10 having a range of different thicknesses. In addition, assembly 26 includes a pair of mounting brackets 30 through which it is mounted to a pair of mounting shafts 32 in a folder-gluer. A lead screw 34 is provided on each mounting bracket 30 for lateral movement and alignment. Assembly 26 further includes an independent drive motor 36 and is adapted for use on a wide range of flexo folder-gluer machines. Motor 36 preferably has variable speeds to match the speed of glue wheels 18 to the surface speed of box blank 12 as it travels through the folder-gluer. Motor 36 preferably drops to idle when the folder-gluer is temporarily stopped but continues to rotate the glue wheels at a slower speed. It is important to rotate the glue wheels to prevent the glue on the outside surface of the active wheel from drying.

Glue shoe 20 has a reservoir 38 therein and glue circulating lines 40, 42 communicate with the reservoir. Input line 40 is used to pump glue, preferably cold glue, into reservoir 38 while return line 42 is used to withdraw glue from the reservoir. The glue is gravity fed through input line from a glue container housed in the top of assembly 26 and pumped out through return line 42. The constant circulation of glue prevents glue on glue applying wheel 18 from drying or changing consistency and is necessary and desirable at any operating speed. The same feature is also particularly needed when feeding of box blanks 12 is interrupted for a significant period of time and no glue is being transferred to glue flaps 10.

Assembly 26 is preferably outfitted with an automatic washout system (not shown) for use in switching from inside or outside gluing of glue flaps 10. The system is controlled with solenoids and first washes out the glue shoe of the glue unit in present use and then starts to circulate glue through the other glue shoe 20.

Figure 3:
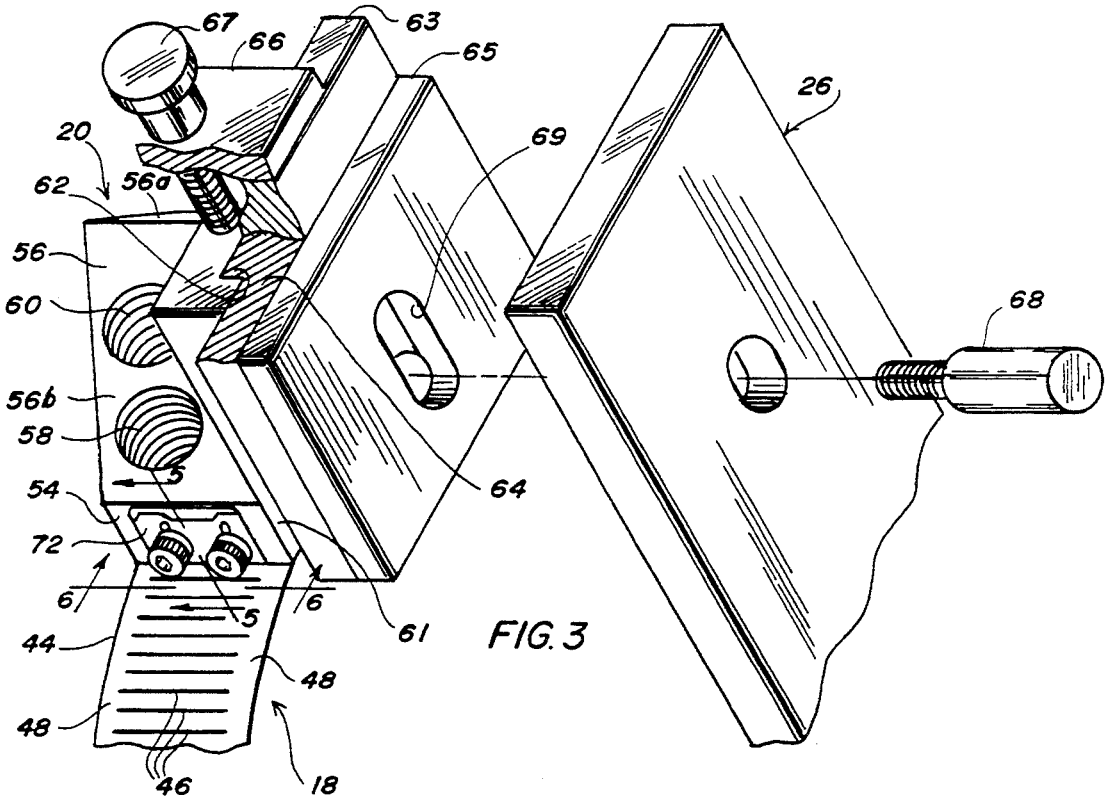
FIG. 3 is a top perspective view of a glue shoe and a glue wheel in accordance with the present invention.

As best seen in FIGS. 1–3, each glue wheel 18 has a rim 44 and an axis of rotation about shafts 22, 24. A plurality of depressions 46 (e.g., grooves and so forth) are spaced, preferably uniformly, about the central portion of rim 44. Depressions 46 are flanked with smooth side sections 48 and are designed to accept a definite predetermined amount of glue in a predetermined pattern upon glue flap 10. The shape of depressions 46 is designed to avoid slinging but allow easy release of the glue from the depressions to the flap. While depressions 46 are illustrated is a plurality of equally spaced parallel grooves running transverse the axis of rotation of glue wheel 18, it will be understood that depressions 46 may take a variety of other forms depending upon the glue pattern that is desired.

Figure 4:
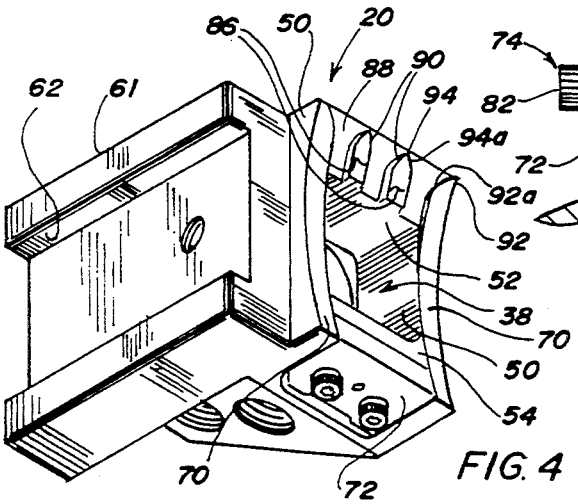
FIG. 4 is a bottom perspective view of the glue shoe.
Figure 5:
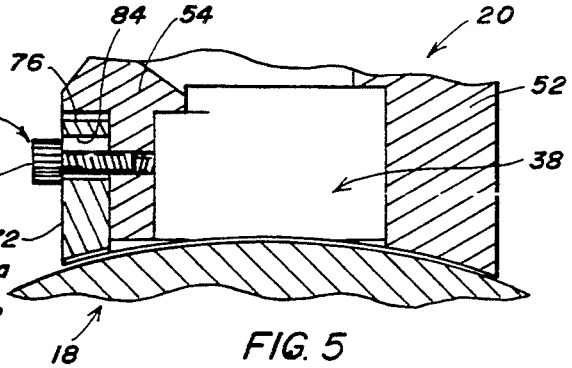
FIG. 5 is a section taken along line 5—5 in FIG. 3.

Moving to FIGS. 3–5, each glue shoe 20 has a pair of side walls 50 and a front and rear walls 52 and 54, respectively. Side walls 50 and front and rear walls 52, 54 are open at the bottom and closed at the top with a top wall 56. Rear wall 54 is taller than front wall 52 such that top wall 56 is ridged with a shorter and longer face **56*a*, 56*b*, respectively. Top wall 56 is provisioned with apertures 58 and 60 for connection to glue recirculating lines 40 and 42. The space between the walls defines reservoir 38. Walls 52, 54 and 56 are configured to increase the volume of reservoir 38. To this same end, return line 42 is connected to upper aperture 60 so that reservoir 38 fills to the bottom of upper aperture 60. In a specific illustrative embodiment, reservoir is approximately 1.5 inches high (measured just below aperture 58) and approximately 1.5 inches long. The width of the reservoir is sufficient to cover the depressions in rim 44 without extending into smooth side sections 48**.

As best seen in FIG. 3, a mounting bracket 61 is attached to one of side walls 50. Bracket 61 has a groove 62 formed in its outside face. Bracket 61 is removably secured to a slide plate 63 with a tongue 64. Tongue 64 is received in groove 62. Slide plate 63 is attached to and part of assembly 26. As illustrated in the drawings, assembly 26 may include a spacer 65.

Slide plate 63 includes a flange 66 along one side edge. An adjustment screw 67 through flange 66 into one end of mounting bracket 61 provides micrometer adjustment means for spacing glue shoe 20 from glue wheel 18. By turning adjustment screw 67, an operator can adjust glue shoe 20 towards and away from glue wheel 18. Glue shoe 20 can then be locked in a selected position with a bolt 68 which is part of assembly 26 and passes through an elongated slot 69 in slide plate 63 (and any spacer 65). Bolt 68 prevents separation of the glue shoe and the glue wheel and leakage when the wheel is rotated at high speeds.

Figure 6:
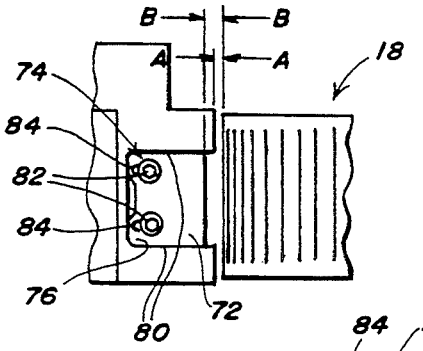
FIG. 6 is a view taken in the direction of line 6—6 in FIG. 3.

Side walls 50 are disposed transversely of the axis of glue wheel 18 and have bottom surfaces 70. Bottom surfaces 70 are curved complementary to and for sealing engagement with smooth side sections 48 of rim 44. The exactitude of the fit between bottom surfaces 70 and smooth side sections 48 is such to preclude leakage of any glue between them. A typical clearance between arrows A—A as shown in FIG. 6 is in the order of 0.001 inch.

Front and rear walls 52, 54 (viewed in the direction that glue wheel 18 rotates under glue shoe 20) are positioned parallel to the axis of said wheel. Rear wall 54 has an adjustable metering plate 72 extending across rim 44 to smooth side sections 48. Means for mounting 74 the metering plate are provided for adjustment of it towards and away from the wheel. As best seen in FIG. 5, rear wall 54 terminates short of side walls 50 and has a recess 76 formed in an outer face for receipt and support of metering plate 72. A bottom surface 78 of metering plate 72 is preferably curved complementary to and for engagement with the complementary area of rim 44 with depressions 46. Recess 76 has a height such that metering plate 72 can be moved toward and away from glue wheel 18 and a width such that lateral sides 80 of the metering plate closely contact and frictionally engage the side walls of the recess.

As illustrated in the drawings, means for mounting 74 the metering plate comprise a pair of screws 82 which received in rear wall 54 and elongated slots 84 which are provided in metering plate 72. To this end, when screws 82 are loosened, metering plate 72 can be adjusted toward and away from rim 44 to the extent permitted by elongated slots 84. When satisfactorily adjusted, metering plate 72 is locked in selected position by tightening screws 82. Typically the adjustable clearance between bottom surface 78 of metering plate 72 and rim 44 (shown as arrows B—B in FIG. 6) is in the order of about 0.001 to about 0.016 inch. Adjustability outside these limits can be provided if required.

Front wall 52 has a bottom surface 86 that is coterminous with bottom surfaces 70 of side walls 50 and like bottom surface 78 of metering plate 72 is preferably curved complementary to and for engagement with that portion of rim 44 with depressions 46. Bottom surface 86 of front wall 52 has a plurality of notches 88 to permit re-entry of glue into reservoir 313. The remaining parts of bottom surface 86 between notches 88 form lands 90 to prevent entry of hardened dust, cardboard trim and the like into reservoir 38 where it may interfere with the application of glue by metering plate 72. To that end, the depth and width of notches 88 are such that the friction force of the wheel acting on the glue is sufficient to force the glue back into reservoir 38. This can be accomplished, for example, when notches 88 are about 0.040 inch deep.

As illustrated in FIG. 4, leading end 92 of each side wall 50 is inwardly curved at 92*a*. This assists side walls 50 in cleaning side sections 48 of rim 44. Leading ends 94 of lands 90 are similarly inwardly curved at 94*a* for removing glue or cardboard trim adhering to rim 44 in the area of depressions 46. Side walls 50 and lands 90 together size the material which is permitted to enter reservoir 38.

In the embodiment illustrated in FIGS. 1–2, a pair of glue units 14, 16 are provided for gluing either the top or the bottom surface of flap 10. It is will understood, however, that one of glue units 14, 16 may be replaced with a roller, in which case assembly 26 can be used for gluing only the top or bottom of the flap. When glue units 14, 16 are provided as a pair, the automatic wash-out system facilitates switching from inside to outside gluing and minimizes down time.

In use, as glue recirculates in reservoir 38, glue wheel 18 rotates under glue shoe 20 and depressions 46 are filled with glue. When glue wheel 18 passes under metering plate 72, metering plate 72 meters a film of glue on rim 44 between smooth side sections 48. When glue wheel 18 contacts glue flap 10, it deposits a neat line of glue end to end of the flap. Any remaining glue on glue wheel 18 is returned to reservoir 38 through front wall 52 which keeps side sections 48 clean and prevents entry of oversized hardened glue and trimmings into reservoir 38.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed:

1. A glue unit for applying glue having a rotatable glue wheel and a glue shoe, means for adjusting the glue shoe linearly towards and away from the glue wheel and locking it in a selected position spaced from the glue wheel a distance sufficient to avoid wear but close enough to prevent leakage of the glue between the glue shoe and the glue wheel, said glue wheel having a rim with depressions flanked with smooth side sections, said glue shoe having side walls and front and rear walls, said side walls disposed transversely of the axis of said wheel and having bottom surfaces, said bottom surfaces of the side walls being curved complementary to and for sealing engagement with the smooth side sections of the rim when the glue shoe is locked in said selected position, said front and rear walls disposed parallel of the axis of said wheel, said rear wall having an adjustable metering plate extending across the rim to the smooth side sections, and means on said glue shoe for mounting said metering plate for adjustment out of contact with the wheel whereby the bottom surfaces of the side walls of the glue shoe clean the smooth side sections of the rim while the metering plate applies a film of glue to the depressions without the glue shoe wearing against the glue wheel or the glue wheel slinging glue.

2. The glue unit of claim 1 wherein the rear wall terminates short of the side walls and has a recess for receipt of the metering plate.

3. The glue unit of claim 2 wherein the metering plate is curved complementary to and for engagement with the rim and has lateral side edges to closely contact and frictionally engage the recess.

4. The glue unit of claim 3 wherein the front wall has a bottom surface coterminous with the bottom surfaces of the side walls and curved complementary to and for engagement with the rim, said front wall further having a plurality of notches separated by at least one land.

5. The glue unit of claim 1 wherein the side, front and rear walls are closed at the top with a top wall and the space between said walls forms a reservoir, said top wall having a pair of apertures for connection to an input and to a return line for circulation of glue through the reservoir.

6. A glue unit for applying glue having a rotatable glue wheel and a glue shoe, means for adjusting the glue shoe linearly towards and away from the glue wheel and locking it in a selected position spaced from the glue wheel a distance sufficient to avoid wear but close enough to prevent leakage of the glue between the glue shoe and the glue wheel, said glue wheel having a rim with depressions flanked with smooth side sections, said glue shoe having side walls and front and rear walls, said side walls disposed transversely of the axis of said wheel and having bottom surfaces, said bottom surfaces of the side walls being curved complementary to and for sealing engagement with the smooth side sections of the rim when the glue shoe is locked in said selected position, said front and rear walls disposed parallel of the axis of said wheel, said front wall having a bottom surface curved complementary to the rim, said rear wall having an adjustable metering plate extending across the rim to the smooth side sections, said metering plate having a bottom surface curved complementary to the rim, said front wall coterminous with the side walls and having a plurality of notches and means on said glue shoe for mounting said metering plate for adjustment out of contact with the wheel whereby the bottom surfaces of the side walls of the glue shoe clean the smooth side sections of the rim while the metering plate applies a film of glue to the depressions without the glue shoe wearing against the glue wheel or the glue wheel slinging glue.

7. The glue unit of claim 6 wherein the side, front and rear walls are closed at the top with a top wall formed from first and second sections meeting at a ridge and the space between said walls forms a reservoir, said front wall being taller than the rear wall and said first section meeting the rear wall and said second section meeting the front wall, said first section having a lower aperture for connection with an input line and an upper aperture for connection with a return line for circulation of glue through the reservoir.

8. The glue unit of claim 7 mounted in assembly with a second glue unit, the glue wheel in said second glue unit serving as a pressure roller when the first glue unit is in use applying glue and the glue wheel in said first glue unit serving as a pressure roller when the second glue unit is in use applying glue.

9. The glue unit of claim 7 wherein the rear wall terminates short of the side walls and has a recess for receipt of the metering plate.

10. The glue unit of claim 9 wherein the metering plate has lateral side edges to closely contact and frictionally engage the recess.

* * * * *